US009945322B2

(12) United States Patent
Wood

(10) Patent No.: US 9,945,322 B2
(45) Date of Patent: Apr. 17, 2018

(54) STIRLING ENGINE OR COOLER HEAT EXCHANGER

(71) Applicant: Sunpower, Inc., Athens, OH (US)

(72) Inventor: James Gary Wood, Albany, OH (US)

(73) Assignee: Sunpower, Inc., Athens, OH (US)

( * ) Notice: Subject to any disclaimer, the term of this patent is extended or adjusted under 35 U.S.C. 154(b) by 219 days.

(21) Appl. No.: 15/098,761

(22) Filed: Apr. 14, 2016

(65) Prior Publication Data

US 2017/0298865 A1 Oct. 19, 2017

(51) Int. Cl.
*F02G 1/057* (2006.01)

(52) U.S. Cl.
CPC ..... *F02G 1/057* (2013.01)

(58) Field of Classification Search
CPC ..... F02G 1/055; F02G 1/057; F02G 2255/20; F28F 1/20; F28F 1/42; F28F 1/426; F28F 1/105
See application file for complete search history.

(56) References Cited

U.S. PATENT DOCUMENTS 4,527,394 A 7/1985 Corey
6,095,236 A * 8/2000 Kuhler ..... B29C 47/003 165/11.1
6,694,731 B2 2/2004 Kamen et al.
8,474,515 B2 7/2013 Burgers et al.
2006/0026835 A1 2/2006 Wood
2009/0193804 A1 8/2009 Ohno et al.

FOREIGN PATENT DOCUMENTS

DE 3034193 A1 * 4/1982 ..... F23C 3/002

* cited by examiner

*Primary Examiner* — Jonathan Matthias
(74) *Attorney, Agent, or Firm* — Frank H. Foster; Kremblas & Foster

(57) ABSTRACT

A free piston Stirling engine with a heat exchanger that has an inner component part assembled within an outer component part. The outer component part has a tubular outer wall and circumferentially spaced ridges that extend radially inward from the tubular outer wall and are separated from each other by inward opening slots. The inner component part has a tubular inner wall and circumferentially spaced ridges that extend outward from the inner tubular wall and are separated from each other by outward opening slots. The ridge widths of the outer and inner component parts are less than the slot widths of the corresponding slots into which they fit. The two component parts are assembled with the ridges of each component part extending into the slots of the other component part to form gas passages between interfacing sidewall surfaces of the ridges.

19 Claims, 5 Drawing Sheets

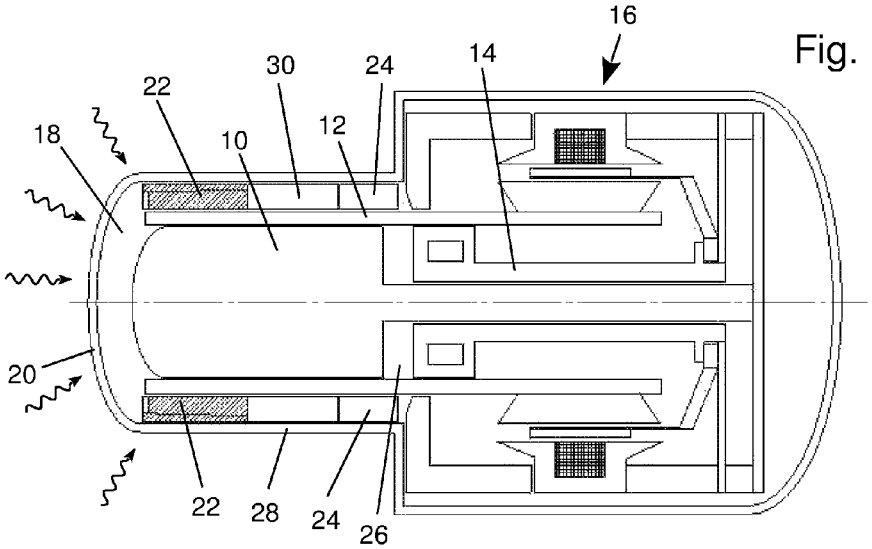
Fig. 1
Fig. 2
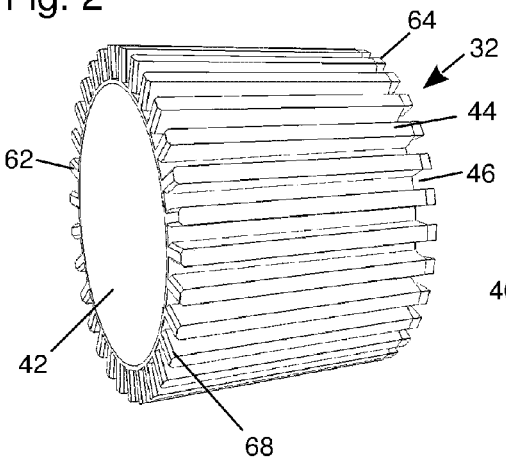
Fig. 3
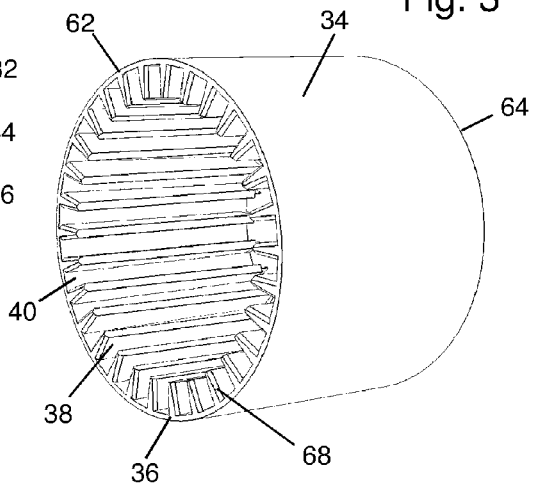
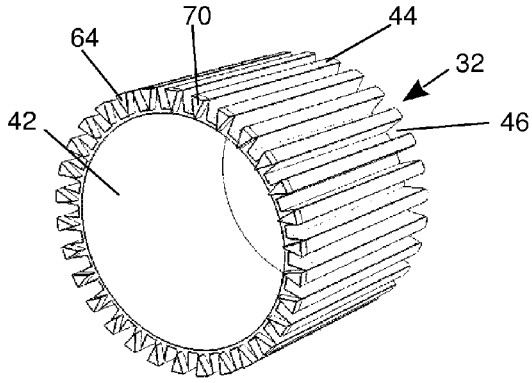
Fig. 4
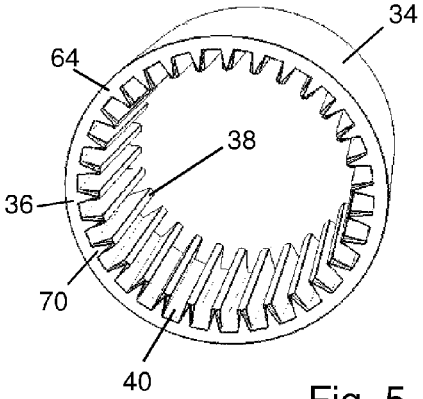
Fig. 5

Fig. 6
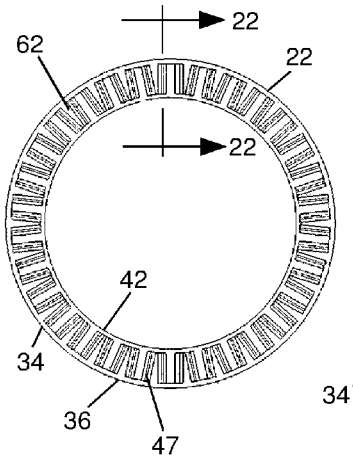
Fig. 7
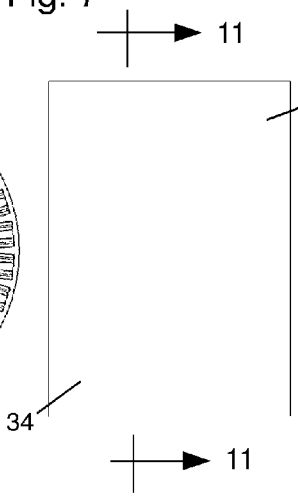
Fig. 8
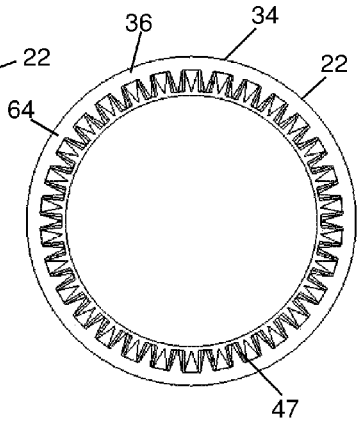
Fig. 9
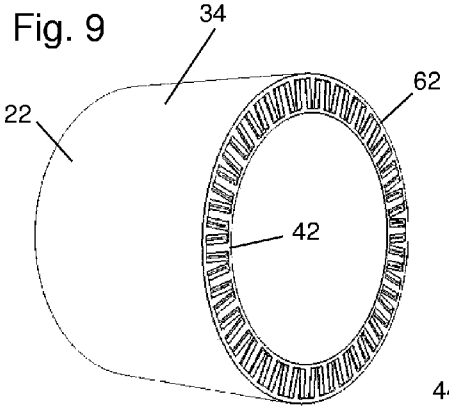
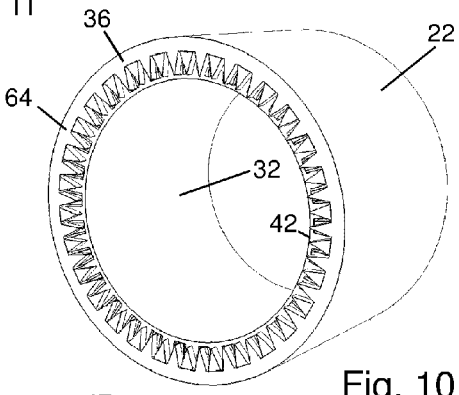
Fig. 10
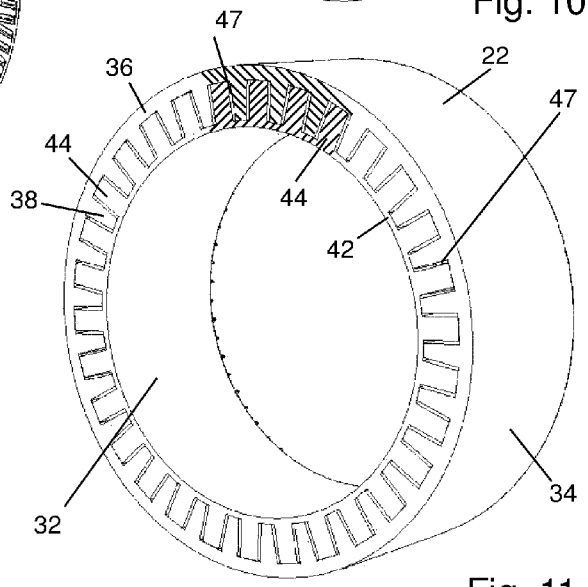
Fig. 11

Fig. 12
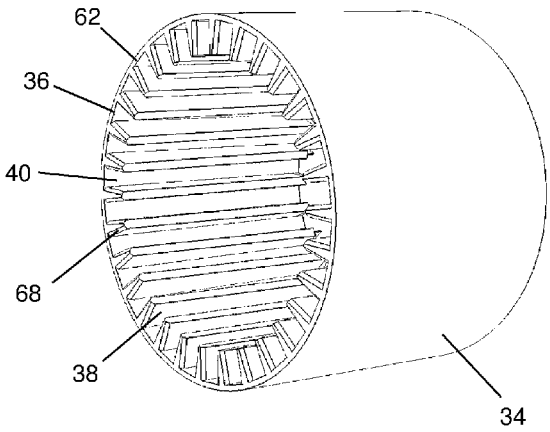
Fig. 13
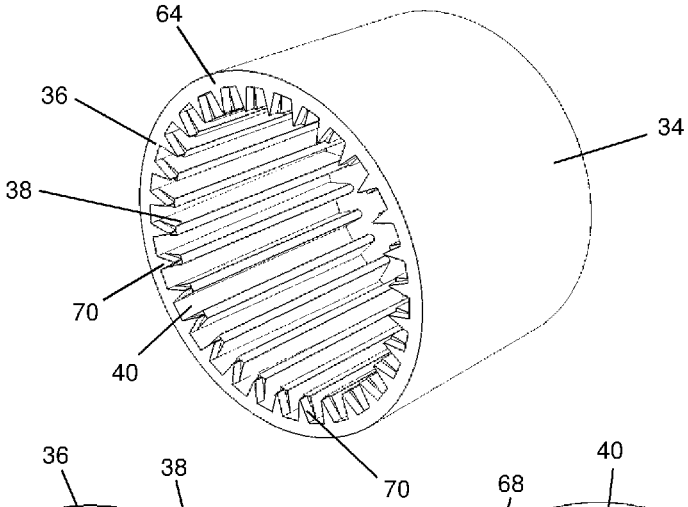
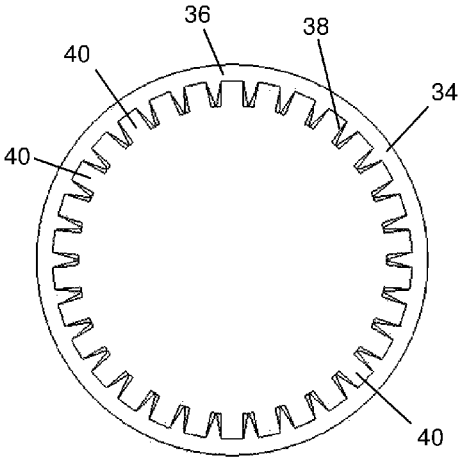
Fig. 14
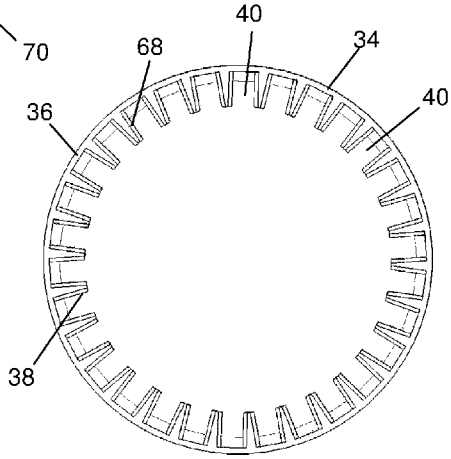
Fig. 15

Fig. 16
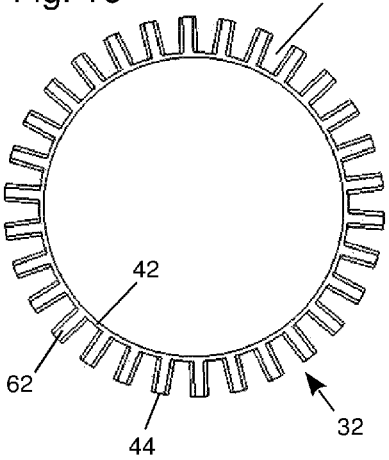
Fig. 17
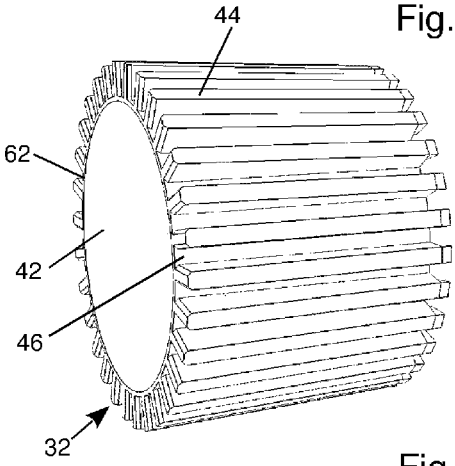
Fig. 18
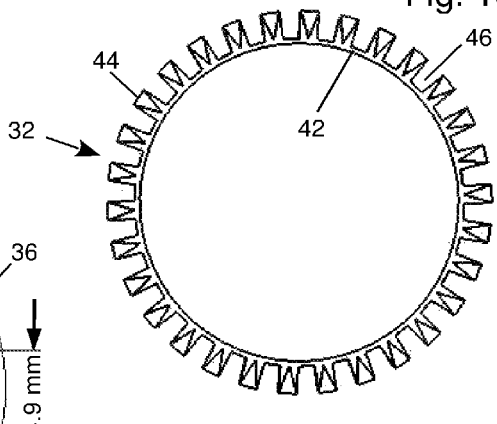
Fig. 19
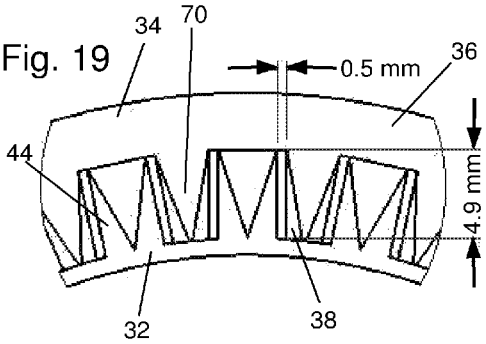
Fig. 21
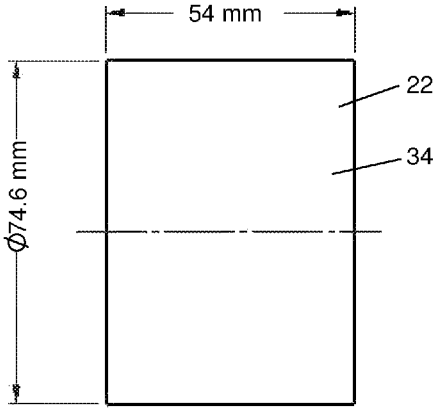
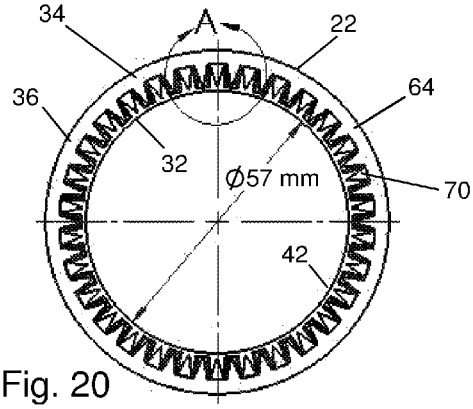
Fig. 20

STIRLING ENGINE OR COOLER HEAT EXCHANGER

BACKGROUND OF THE INVENTION

This invention is directed to improvements in Stirling engines and can be used in other Stirling machines, such as Stirling coolers and may have utility as a heat exchanger in other specialty machines. More particularly the invention is directed to improvements in heat exchangers used in these machines.

FIG. 1 is a diagram of a free piston Stirling engine driving an electrical alternator to supply electrical power. As well known to those skilled in the art of free piston Stirling engines, the engine has a displacer 10 that reciprocates in a cylinder 12 and a reciprocating power piston 14 that drives the magnets of the alternator 16. An expansion space 18 opens into an end of the cylinder 12 in the head 20 at the hot end of the engine. The engine has a heat accepting heat exchanger 22 that is adjacent to, and opens into, the expansion space 18 and a heat rejecting heat exchanger 24 adjacent to, and opening into, a compression space 26. These heat exchangers 22 and 24 extend around the cylinder 12 immediately inside of, and in thermally conductive contact with, an outer casing 28. The heat exchangers 22 and 24 are connected to, and open into, opposite ends of a regenerator 30.

Working gas flows in alternating directions between the expansion space 18 and the compression space 26 through the series-connected compression space heat exchanger 24, the regenerator 30 and the expansion space heat exchanger 22. The purpose of Stirling machine heat exchangers is to transfer heat to or from the working gas. For a typical Stirling engine, a heat source, such as a gas flame, is applied to the head 20 for supplying the heat energy that drives the engine. The purpose of the expansion space heat exchanger 22 is to transfer heat from that heat source into the working gas within the engine as the working gas flows in alternating directions through the expansion space heat exchanger 22.

FIG. 1 shows the location of the heat exchanger 22 according to the invention positioned in an otherwise conventional Stirling engine. That heat exchanger 22 has a regenerator end that is connected to the regenerator 30 and an expansion space end that is connected to open into the expansion space 18.

In order to have a high heat transfer rate from the heat exchanger to the working gas flowing through the heat exchanger, it is desirable to have a large number of gas passages that are small in cross section in a plane that is perpendicular to the gas flow direction through the passages. That configuration provides a larger total surface area in contact with the gas for facilitating heat transfer. However, heat exchangers of the prior art that have sufficiently small passages are very costly if those passages are machined by conventional machining tools and techniques because of the difficulty of machining so many passages that are as small as needed. Folded fin heat exchangers have also been used but the passages cannot be made sufficiently small. Sometimes folded fin heat exchangers have been partially crushed to reduce the passage size. But this crushing makes the passages non-uniform in their cross sectional area and therefore non-uniform in flow resistance and heat transfer rate.

One purpose of the present invention is to provide an improved heat exchanger that has thin, narrow gas passages through the heat conducting metal of the heat exchanger without having to machine thin narrow passages. Embodiments of the invention have sufficiently small gas passages but do not require the machining of passages that are as small as the gas passages in the completed heat exchanger.

Another purpose of the invention is to provide a heat exchanger that has a simple structure, is relatively easy to machine and to assemble and therefore has a lower manufacturing cost.

Yet another purpose of the invention is to provide a heat exchanger with very few parts and very few part connections and joints which results in a lower cost heat exchanger that has improved reliability and durability.

Unlike some prior art heat exchangers that require a separately manufactured manifold for interconnecting the heat exchanger to the regenerator, the heat exchanger of the invention can be cast or machined with annular shoulders or other interfacing edges at an end that can fit directly against the regenerator and consequently eliminate the need for a separate manifold.

BRIEF SUMMARY OF THE INVENTION

The invention is a free piston Stirling engine and particularly the heat exchanger at its heat accepting end. The heat exchanger has an inner component part that is assembled within an outer component part. The outer component part has a tubular outer wall and circumferentially spaced ridges that extend inward from the tubular outer wall and also extend longitudinally along the tubular outer wall. The inward extending ridges are separated from each other by inward opening slots. The inner component part has a tubular inner wall and circumferentially spaced ridges that extend outward from the inner tubular wall and also extend longitudinally along the tubular inner wall. The outward extending ridges are separated from each other by outward opening slots. The ridge widths of the outer component part are less than the slot widths on the inner component part and the ridge widths of the inner component part are less than the slot widths of the outer component part so that the ridges can fit into the slots. The two component parts are assembled with the ridges of each component part extending into the slots of the opposite component part to form gas passages between interfacing sidewall surfaces of the ridges.

BRIEF DESCRIPTION OF THE SEVERAL VIEWS OF THE DRAWINGS

FIG. 1 is a diagram of a free piston Stirling engine that includes a heat exchanger embodying the invention.

FIG. 2 is a view in perspective of the inner component part of an embodiment of the invention.

FIG. 3 is a view in perspective of the outer component part of the same embodiment of the invention.

FIG. 4 is another view in perspective of the same inner component part of an embodiment of the invention.

FIG. 5 is another view in perspective of the same outer component part of an embodiment of the invention.

FIG. 6 is an end view of the regenerator end of the assembled inner and outer component parts of the embodiment of the invention that is illustrated in the other views.

FIG. 7 is a side view of the embodiment that is illustrated in FIG. 6 and the other views.

FIG. 8 is an end view of the expansion space end of the assembled inner and outer component parts of the embodiment of the invention that is illustrated in the other views.

FIG. 9 is a view in perspective of the assembled inner and outer component parts of the embodiment of the invention that is illustrated in the other views with the regenerator end of the embodiment visible.

FIG. 10 is a view in perspective of the assembled inner and outer component parts of the embodiment of the invention that is illustrated in the other views with the expansion space end of the embodiment visible.

FIG. 11 is a perspective view in section taken substantially along the line 11-11 of FIG. 7.

FIG. 12 is another view in perspective of the same outer component part of an embodiment of the invention with the regenerator end visible.

FIG. 13 is another view in perspective of the same outer component part of an embodiment of the invention with the expansion space end visible.

FIG. 14 is an end view of the same outer component part of an embodiment of the invention looking at the expansion space end of that outer component part.

FIG. 15 is an end view of the same outer component part of an embodiment of the invention looking at the regenerator end of that outer component part.

FIG. 16 is an end view of the same inner component part of an embodiment of the invention looking at the regenerator end of that outer component part.

FIG. 17 is another view in perspective of the same inner component part of an embodiment of the invention with the regenerator end visible.

FIG. 18 is an end view of the same inner component part of an embodiment of the invention looking at the expansion space end of that inner component part.

FIG. 19 is an end view of an enlarged segment of the assembled inner and outer component parts of the same embodiment of the invention and showing dimensions.

FIG. 20 is an end view of the assembled inner and outer component parts of the same embodiment of the invention and showing dimensions.

FIG. 21 is a side view of the embodiment illustrated in FIG. 20.

Figure 22:
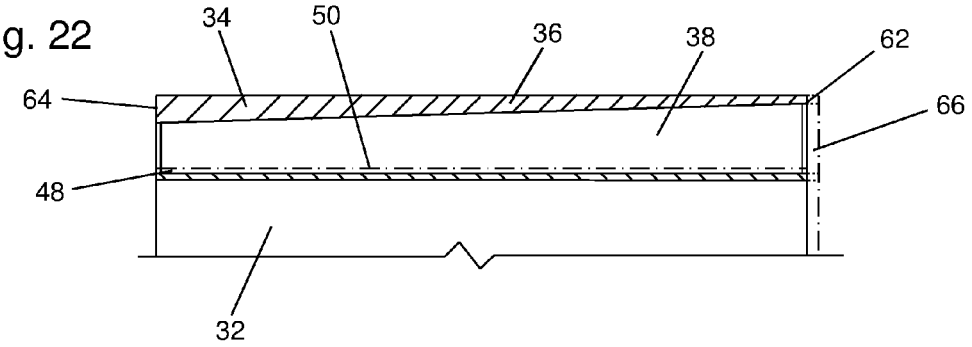
FIG. 22 is an enlarged view in section of a segment of the embodiment illustrated in the other Figures taken substantially along the line 22-22 of FIG. 6.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

In describing the preferred embodiment of the invention, reference will be made to various terms that are used for describing their characteristics. The terms "inward" and "outward" are used and denote a direction generally along radials toward or away from a central axis of a pair of concentric tubular walls. The term "longitudinal" is used principally to refer to a direction that is parallel to the central axis which is also the gas flow direction through the preferred embodiment of the invention. The term "gas passage width" is used to refer to the distance in a circumferential direction between the interfacing sidewall surfaces of the ridges that bound the gas passages and are subsequently described. The term "ridge height" refers to the distance in a radial direction from the base of a ridge to the crest of a ridge. The terms "inward opening slot" and "outward opening slot" mean that the open end of the slot faces inward or outward respectively.

The principal and most advantageous application of the invention is for a heat exchanger that is positioned at the heat accepting end of a Stirling engine where the heat flux is greatest. However, it can also be used at the heat rejecting end. It can also be used at the heat accepting and/or the heat rejecting end of a Stirling cooler, cryocooler or heat pump and its most advantageous application to a heat pumping Stirling machine is at the heat rejecting end of a cryocooler where the heat flow is greater.

The most common positioning of a heat exchanger 22 embodying the present invention is illustrated in FIG. 1 around the heat accepting end of a Stirling engine. In FIGS. 2-23, the heat exchanger 22 is illustrated in several orientations, both assembled and unassembled. The heat exchanger 22 has two principal component parts that are separately manufactured. They are assembled by sliding an inner component part 32 into an outer component part 34. Preferably, the two component parts are constructed of copper.

The outer component part 34 has a tubular outer wall 36 which preferably is circularly cylindrical. A series of circumferentially spaced ridges 38 extend inward from the outer wall 36 and form a unitary body with the tubular outer wall 36. The ridges 38 also extend longitudinally along the tubular outer wall 36. The ridges 38 of the outer component part 34 are separated from each other by inward opening slots 40. The sidewall surfaces of the ridges 38 are the same as the sidewall surfaces of the slots 40 because the sidewall surfaces of the ridges define the sidewalls of the slots. Preferably, all those sidewall surfaces are planar surfaces.

The inner component part 32 has a tubular inner wall 42 which preferably is also circularly cylindrical. A series of circumferentially spaced ridges 44 extend outward from the inner tubular wall 42. The ridges 44 also extend longitudinally along the tubular inner wall 42. The outward extending ridges 44 of the inner component part 32 are separated from each other by outward opening slots 46. Preferably, the centerlines of the ridges on both component parts and the centerlines of the slots on both component parts are along radials from the central axis. But, as subsequently will be seen, preferably the sidewall surfaces of the ridges and the slots do not fall precisely along radials, although they could be constructed in that manner.

As illustrated in FIGS. 6-11 and 19-23, the inner and outer component parts are assembled with the inner component part 32 having its tubular inner wall 42 positioned within the outer component part 34. Although unnecessary for some applications of the invention, the two component parts 32 and 34 can be bonded together, such as by brazing or diffusion bonding, most conveniently when the heat exchanger is bonded to the casing 28 of the Stirling machine.

Importantly, the ridge widths of the outer component part are less than the slot widths on the inner component part and the ridge widths of the inner component part are less than the slot widths of the outer component part so that the ridges can fit into the slots. However, it is not necessary that the two component parts have either the same ridge width or the same slot width, as long as the ridges of each component part can fit into the slots of the other component part. The component parts are assembled so that the ridges of each component part extend into the slots of the opposite component part. Because the slots are wider than the ridges, gas passages 47 are formed between the interfacing sidewall surfaces of the ridges. If, as desired, the ridges are centered in the slots, the gas passages 47 on the two opposite sides of each ridge have the same width. Consequently, the width of the gas passages 47 are one half of the difference between the width of a slot and the width of the ridge in the slot. The preferred width of the gas flow passages is a function of the particular machine design, which can vary over a range of power outputs. For the most common applications, the preferred gas passage width is in the range of 0.25 mm to 1.5 mm.

The above-described dimensional relationship between the respective widths of the ridges and the slots has important consequences. The ridges are formed by machining the slots into the inner and outer component parts. The width of the slots is determined by the width to which the slot is machined. The width of the ridges is determined by the spacing of the slots between the ridges. Because the width of the gas passages 47 is one half of the difference between the slot width and the ridge width, the slots and the ridges can be machined much wider than the desired width of the gas passages. The ridges and slots are made to have a width difference that is much less than the width of the slots that are machined into the inner and outer component parts. The ultimate result is that the machining operations are much less expensive with the invention because it is much less expensive to machine wide slots than it is to machine thin, narrow slots or other passages. For example, the wide slots can be machined by broaching, a machining process in which a multiple tooth cutting tool is moved linearly relative to the work in the direction of the tool axis.

Another advantage of the invention is that the relatively wide ridges that separate the gas passages 47 and form the walls of the gas passages 47 extend radially so that heat conducting metal extends along a wide conductive path continuously and directly from the outer surface of the heat exchanger to side walls of the gas passages 47. That configuration maximizes heat conduction from the outer surface of the heat exchanger, where heat is input to the Stirling engine, to the walls of the gas passages 47 where heat is transferred to the gas in the passages 47.

Ridge Gap.

Embodiments of the invention could be manufactured with the height of all the ridges equal to the height of all the slots so that the crests of all the ridges are in contact with the bottoms of all the slots when the two component parts are assembled. However, that would require machining the component parts with more precision and closer tolerances which would needlessly increase the cost of manufacture. It is also possible to custom machine each slot and its received ridge to a height that differs from the heights of other slots and ridges. However, that would make embodiments of the invention even more expensive to machine and assemble.

Figure 23:
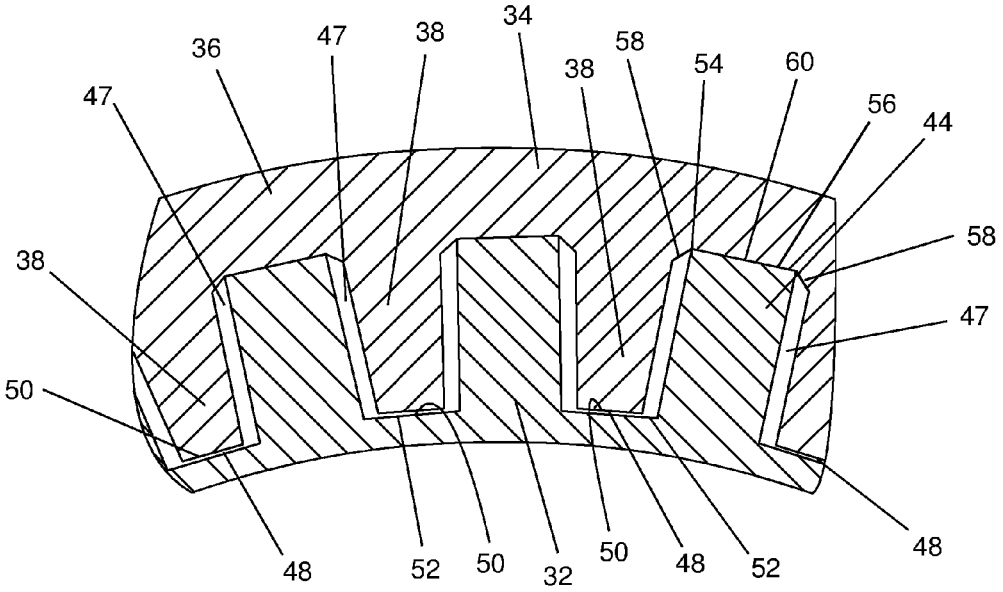
FIG. 23 is a view of an enlarged segment of the embodiment illustrated in the other Figures taken substantially along the line 11-11 of FIG. 7.

Referring to FIGS. 22 and 23, preferably the inward extending ridges 38 of the outer component part 34 have a ridge height that is less than the ridge height of the outward extending ridges 44 of the inner component part 32. This permits formation of a gap 48 between crests 50 of the inward extending ridges 38 of the outer component part 34 and the bottoms of the outward opening slots 46 of the inner component part 32 (which is the outer surface of the tubular inner wall 42 of the inner component part 32) [In FIG. 22 the crest 50 is shown in phantom because the gap 48 is a desirable but unnecessary enhancement of the invention]. The result of this height relationship is that there is no metal to metal contact across this gap 48. The gap 48 provides a high thermal resistance to heat flow from the outer component part 34 to the inner component part 32. However, the crests of the outward extending ridges 44 are in direct contact with the tubular outer wall 36 of the outer component part 34 to provide a low thermal resistance to heat flow.

The general purpose of the heat exchanger is to conduct heat from the flame or other driving heat source to the walls of the gas passages 47 so that heat will be transferred to the gas in the gas passages 47 of the heat exchanger. The reason for the ridge gap 48 is to reduce machining cost by not requiring the close tolerance machining that would be required if all the ridge crests of both component parts were to contact the bottom of all their respective slots .

An additional advantage of the gap 48 is that it adds additional gas passage cross sectional area for gas flow and additional surface area for transferring heat to the working gas. Preferably, the inner ridge gaps 48 should be equal to or less than the width of the gas passages 47. If the gaps 48 are larger in width than gas passages 47, they would have less resistance to gas flow, more gas would flow in gaps 48 and less would flow in the preferred gas passages 47. If gaps 48 and gas passages 47 are equal in width, that is useful because gaps 48 provide additional effective heat exchange passages. For that reason, it is undesirable to have large gaps 48 because that would allow more gas to flow in this less effective heat exchange region.

The desirable heat flow in the metal of the heat exchanger is to transfer heat, which is received by the outer component part 34 from the engine's heat source, to the gas in the gas passages 47. To do that, heat is conducted from the tubular outer wall 36 of the outer component part 34 to the walls of the ridges 38 and 44 because those walls are in contact with the working gas in gas passages 47 of the heat exchanger. Consequently, it is desirable to have highly thermally conductive contact between the crests of the outward extending ridges 44 of the inner component part 32 and the tubular outer wall 36 of the outer component part 34.

Uniform Gas Passage Width.

From the drawings and the above description it is apparent that the sidewall surfaces of the ridges and slots could lie along radials from the axis of the heat exchanger component parts 32 and 34. Although that configuration is acceptable for some applications, the gas passages would be slightly wedge shaped with the gas passages becoming progressively wider as they extend further in the outward direction.

However, as illustrated in FIG. 23, it is preferred that each pair of interfacing sidewall surfaces of the ridges, which together form the sidewalls of each gas passage 47, lie along parallel planes. That causes the gas passage between each pair of interfacing sidewall surfaces to have a uniform lateral width. The lateral width of the gas passages 47 in the illustrated preferred embodiment is in the circumferential direction of the heat exchanger and is uniform both longitudinally along the length of the gas passage 47 and across the passage 47 in the radial direction. This uniform lateral width provides more uniformly distributed gas flow and heat transfer along the gas passages.

One way of accomplishing this is to machine the slots of one component part with parallel sidewall surfaces and machine the ridges of the other component part with parallel sidewall surfaces. As seen in FIG. 23, that will also mean that, on the component part that has slots with parallel sidewall surfaces, its ridges will have sidewall surfaces that are tapered. Similarly, on the component part that has its ridges with parallel sidewall surfaces, its slots will have tapered sidewall surfaces. For assembly, the tapered ridges are inserted within the tapered slots and the ridges with parallel sidewall surfaces are inserted within the slots with parallel sidewall surfaces. Either the outer component part 34 or the inner component part 32 can have the slots with parallel sidewalls with the other component part having the ridges with parallel sidewalls.

In FIGS. 2-22 the difference between the angles that parallel sidewall surfaces of the ridges and slots make with respect to radials is not apparent because the angle difference is too small to be visible. The drawings represent a heat exchanger that is approximately 75 mm in outside diameter with gas passages 47 of approximately 1 mm in width. With those dimensions, the angle is relatively small between a radial and either of two planes that are parallel to each other and centered on opposite sides of the radial. Consequently, the angular difference between the orientation of some ridge and slot sidewalls and the orientation of others is not visibly perceptible except on FIG. 11 and the greatly enlarged FIGS. 19 and 23.

Rotational Alignment.

Preferably, all of the ridges and slots on the outer component part 34 are the same size and shape and are uniformly distributed around its tubular outer wall 36. Similarly and preferably, all of the ridges and slots on the inner component part 32 are the same size and shape and are uniformly distributed around its tubular inner wall 42. It is desirable to have the ridges centered in the slots when the inner component part 32 is assembled into the outer component part 34. The reason for centering is to make the gas passages 47, that are on opposite sides of a ridge, have the same width. Therefore, the two component parts 32 and 34 should be rotationally aligned when they are assembled.

Rotational alignment of the inner component part 32 relative to the outer component part 34 in a manner that centers the ridges in the slots can be conveniently accomplished by forming a surface contour on at least one crest of the outward extending ridges 44, and preferably on all of them, and a mating surface contour on the bottom of at least one slot in the outer component part 34, and preferably into all of them. These mating surface contours are centered on the crest and on the bottom of the slot for centering the ridges in the slots. They are similar to the formation of a key and keyway on the inter-fitting component parts. An example is illustrated in FIG. 23 in which a slot has a bottom 54 that consists of a planar segment 56, which is represented by a line in the circumferential direction, and inclined surfaces 58 at opposite sides of the planar segment 56. The slot bottom functions as a keyway. The crest 60 of the outward extending ridge 44 is formed as a plane with a width equal to the width of the planar segment 56 of the slot so the ridge functions like a key. The crest 60 is guided by the inclined surfaces 58 into the center of the bottom of the slot. From the above it should be obvious that a broad variety of other mating surface contours can be formed on the crests of the ridges and the bottoms of the slots for similarly guiding the ridges 44 into the center of the inwardly opening slots 40.

Tapered Outer Wall.

Referring to FIG. 22, another enhancement of the invention has the tubular outer wall 36 of the outer component part 34 formed to have a thickness (in the radial direction) that is tapered from a thinner regenerator end 62 to a thicker expansion space end 64. As a consequence, the ridge height of the inward extending ridges 38 are inversely tapered from a greater height at the regenerator end 62 to a smaller height at the expansion space end 64. Similarly, the outward extending ridges 44 of the inner component part 32 have a conforming taper along their crests that is the inverse of the thickness taper and have a height so they contact the outer tubular wall 36 along the entire length of the outward extending ridges 44. The preferred taper is at an angle with the longitudinal axis that is less than 10° and most preferably is substantially 3°.

Although the taper that is described above is not necessary for use with embodiments of the invention, it has multiple desirable consequences when applied to embodiments of the invention.

An advantageous consequence of the above described taper is that the taper makes it easier to assemble the two component parts together. As a result of the taper, the bottom surfaces of the inward opening slots 40 of the outer component part 34 lie along a cone. Similarly, the crests of the outward extending ridges 44 of the inner component part 32 also lie along a cone. Those cones are preferably identical. When the two component parts 32 and 34 are aligned coaxially and moved together along the common axis, the two component parts 32 and 34 do not contact each other or slide in frictional contact against each other until the conically arranged crests of the outward extending ridges 44 seat against the conically arranged bottoms of the inward opening slots 40 of the outer component part 34. Upon that seating, the two component parts can slide no further with respect to each other. At that point of contact, the two component parts are brazed or otherwise bonded together.

Of course the crests of the outward extending 44 ridges and the bottoms of the inward opening slots 40 can be machined to lie along a circular cylinder instead of a cone. It would then be necessary to slide the two parts together in frictional contact when the inner part is inserted into the outer part. The relative axial positioning of the inner part and outer part would be indefinite and require insertion to a measured distance followed by brazing or other bonding together. Alternatively, the two component parts can be attached together by heating the outer part to expand it, sliding it over the inner part and then allowing the parts to cool so they are connected together by thermal shrinking.

Another advantage of the above-described taper is obtained by placing the thicker part of the tubular outer wall 36 at the expansion space end 64 of the heat exchanger where the heat flux is the greatest in a Stirling engine. The thicker part provides a greater circumferential cross sectional area for heat conduction through the metal of the heat exchanger in this region of high heat flux in turn promoting more uniform circumferential head temperature. The reason for the high heat flux near the expansion space is that the working gas has expanded and cooled significantly in the expansion space before gas flows from the expansion space into the heat exchanger. So there is a large temperature difference between the heat exchanger at this region and the gas that has been cooled in the expansion space.

Another advantage of the taper is that, because of the taper, the gas passages have a smaller dimension in the radial direction at the expansion space end 64 of the heat exchanger than at the regenerator end 62. This allows the manifold that connects the end of the heat exchanger to the expansion space to be made smaller. As a consequence, the effective volume of the expansion space is less so more power output is produced.

The effective volume of the expansion space can also be reduced by forming projections 70 on the ends of the ridges at the expansion space end 64 of the heat exchanger. In the drawings, the projections 70 are triangular.

Regenerator End Finishing.

Typically it is undesirable to have a regenerator directly engaging right up against the heat exchanger gas passages because gas flow would be restricted. In the prior art a separate manifold is sometimes interposed between the heat exchanger and the regenerator. The manifold is a spacer that provides an open space, for example 1 mm, between the regenerator and the gas passages of the heat exchanger. Referring to FIG. 22, a preferred embodiment of the invention can optionally be formed with an extension 66 (shown in phantom) that forms a unitary manifold as part of the heat exchanger. This eliminates the need for a separate manifold and the need for assembling and aligning a separate manifold.

Additionally, the ends of the ridges of both the inner and the outer component parts are optionally chamfered at the regenerator end 62 for providing a smoother transition of the gas flow path between the regenerator 30 and the heat exchanger 22. The chamfered surfaces 68 are surfaces that are inclined to the gas flow direction to provide a less abrupt, smoother transitions between the regenerator and the heat exchanger. The gas passing between the regenerator and the heat exchanger is directed more smoothly between them and can more smoothly change its velocity. This helps avoid creating additional turbulence which is not desirable because it causes more pressure drop through the heat exchanger and non-uniform flow in the regenerator.

As stated above, the principal and most advantageous application of the invention is for a heat exchanger that is positioned at the heat accepting end of a Stirling engine where the heat flux is greatest. However, it can also be used at the heat rejecting end and can be used at the heat accepting and/or the heat rejecting end of a Stirling cooler, cryocooler or heat pump. However, if it is used at the heat rejecting end of the regenerator, it should not have an axial taper or, if an axial taper is used, the taper should be small.

REFERENCE NUMBER LIST

10 displacer
12 cylinder
14 power piston
16 alternator.
18 expansion space
20 head
22 heat exchanger
24 heat rejecting heat exchanger
26 compression space
28 outer casing
30 regenerator
32 inner component part
34 outer component part
36 tubular outer wall (on outer component part 34)
38 ridges (on outer component part 34)
40 slots (on outer component part 34)
42 inner tubular wall (on inner component part 32)
44 ridges (on inner component part 32)
46 slots (on inner component part 32)
47 gas passages
48 ridge gap
50 crests (of the inward extending ridges 38) 54 slot bottom
56 planar segment
58 inclined surfaces
60 crest (of the outward extending ridge 44)
62 regenerator end
64 expansion space end
66 extension
68 chamfered surfaces
70 projections This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A Stirling engine including an expansion space, a regenerator and a heat exchanger around the Stirling engine, the heat exchanger providing a working gas connection between the regenerator and the expansion space and more particularly comprising:

(a) an outer component part having a tubular outer wall and circumferentially spaced ridges extending inward from the outer wall and extending longitudinally along the tubular outer wall, the inward extending ridges of the outer component part having a ridge width in the circumferential direction and separated from each other by inward opening slots, the inward opening slots of the outer component part having a slot width in the circumferential direction;

(b) an inner component part having a tubular inner wall and circumferentially spaced ridges extending outward from the inner tubular wall and extending longitudinally along the tubular inner wall, the inner component part having its tubular inner wall positioned within the outer component part, the outward extending ridges of the inner component part having a ridge width in the circumferential direction and are separated from each other by outward opening slots, the outward opening slots of the inner component part having a slot width in the circumferential direction, the ridges of each component part extending into the slots of the opposite component part, the ridge widths of the outer component part being less than the slot widths on the inner component part into which they extend and the ridge widths of the inner component part being less than the slot widths of the outer component part into which they extend to form gas passages between interfacing sidewall surfaces of the ridges.

2. A Stirling engine in accordance with claim 1 wherein the tubular inner wall and the tubular outer wall are circularly cylindrical and have a common longitudinal axis and wherein centerlines of the ridges and slots extend along radials of the longitudinal axis of the cylindrical walls.

3. A Stirling engine in accordance with claim 2 wherein each pair of interfacing sidewall surfaces of the ridges lie along parallel planes so that the gas passage between each pair of interfacing sidewall surfaces has a uniform lateral width.

4. A Stirling engine in accordance with claim 3 wherein the uniform lateral width is in the range of 0.25 mm to 1.5 mm.

5. A Stirling engine in accordance with claim 3 wherein at least one crest of the outward extending ridges of the inner component part and at least one bottom of a slot in the outer component part have mating surface contours, the mating surface contours being centered on the crest and on the bottom of the slot for centering the ridges in the slots.

6. A Stirling engine in accordance with claim 3 wherein the inward extending ridges of the outer component part have a ridge height and the outward extending ridges of the inner component part have a ridge height and wherein the height of the inward extending ridges of the outer component part is less than the height of the outward extending ridges of the inner component part to form a gap between crests of the inward extending ridges of the outer component part and the tubular inner wall of the inner component part.

7. A Stirling engine in accordance with claim 3 wherein the heat exchanger has a regenerator end for connection to the regenerator and wherein the regenerator ends of the ridges are chamfered for providing a smoother transition of the gas flow path between the regenerator and the heat exchanger.

8. A Stirling engine in accordance with claim 3 wherein the tubular outer wall of the outer component part has a thickness that is tapered from a thinner regenerator end to a thicker expansion space end and the ridge height of the inward extending ridges are correspondingly tapered from a greater height at the regenerator end to a smaller height at the expansion space end.

9. A Stirling engine in accordance with claim 3 wherein the heat exchanger has an expansion space end and the expansion space ends of the ridges have projections for reducing the effective volume of the expansion space.

10. A Stirling engine in accordance with claim 9 wherein the taper is at an angle with the longitudinal axis that is less than 10°.

11. A Stirling engine in accordance with claim 10 wherein the angle is substantially 3°.

12. A heat exchanger for exchanging heat between internal gas passages and an outer wall, the heat exchanger comprising:

(a) an outer component part having a tubular outer wall and circumferentially spaced ridges extending inward from the outer wall and extending longitudinally along the tubular outer wall, the inward extending ridges of the outer component part having a ridge width in the circumferential direction and separated from each other by inward opening slots, the inward opening slots of the outer component part having a slot width in the circumferential direction;

(b) an inner component part having a tubular inner wall and circumferentially spaced ridges extending outward from the inner tubular wall and extending longitudinally along the tubular inner wall, the inner component part having its tubular inner wall positioned within the outer component part, the outward extending ridges of the inner component having a ridge width in the circumferential direction and are separated from each other by outward opening slots, the outward opening slots of the inner component part having a slot width in the circumferential direction, the ridges of each component part extending into the slots of the opposite component part, the ridge widths of the outer component part being less than the slot widths on the inner component part into which they extend and the ridge widths of the inner component part being less than the slot widths of the outer component part into which they extend to form gas passages between interfacing sidewall surfaces of the ridges.

13. A heat exchanger in accordance with claim 12 wherein the inward extending ridges of the outer component part have a ridge height and the outward extending ridges of the inner component part have a ridge height and wherein the height of the inward extending ridges of the outer component is less than the height of the outward extending ridges of the inner component to form a gap between crests of the inward extending ridges of the outer component part and the tubular inner wall of the inner component part.

14. A heat exchanger in accordance with claim 13 wherein each pair of interfacing sidewall surfaces of the ridges lie along parallel planes so that the gas passage through each pair of interfacing sidewall surfaces has a uniform lateral width.

15. A heat exchanger in accordance with claim 14 wherein the tubular inner wall and the tubular outer wall are circularly cylindrical and have a common longitudinal axis and wherein centerlines of the ridges and slots extend along radials of the longitudinal axis of the cylindrical walls.

16. A heat exchanger in accordance with claim 15 wherein the uniform lateral width is in the range of 0.5 mm to 1.5 mm.

17. A heat exchanger in accordance with claim 15 wherein at least one crest of the outward extending ridges of the inner component part and at least one bottom of a slot in the outer component part have mating surface contours, the mating surface contours being centered on the crest and on the bottom of the slot for centering the ridges in the slots.

18. A heat exchanger in accordance with claim 15 wherein the tubular outer wall of the outer component part has a thickness that is tapered from a thinner regenerator end to a thicker expansion space end and the ridge height of the inward extending ridges are correspondingly tapered from a greater height at the regenerator end to a smaller height at the expansion space end.

19. A heat exchanger in accordance with claim 18 wherein the taper is at an angle with the longitudinal axis that is less than 10°.

* * * * *